United States Patent [19]

Sadler et al.

[11] 4,422,229

[45] Dec. 27, 1983

[54] METHOD OF MAKING AN AIRFOIL MEMBER FOR A GAS TURBINE ENGINE

[75] Inventors: John H. R. Sadler, Aston-on-Trent; George Pask, Stanton-by-Bridge; Wilfred H. Wilkinson, Turnditch, all of England

[73] Assignee: Rolls-Royce Limited, London, England

[21] Appl. No.: 331,201

[22] Filed: Dec. 16, 1981

Related U.S. Application Data

[62] Division of Ser. No. 121,481, Feb. 14, 1980, abandoned.

[30] Foreign Application Priority Data

Feb. 24, 1979 [GB] United Kingdom ..... 7906623

[51] Int. Cl.[3] ..... B23P 15/02; B23P 13/00

[52] U.S. Cl. ..... 29/156.8 H; 29/527.6; 164/98; 164/112

[58] Field of Search ..... 29/156.8 H, 156.8 B, 29/527.6; 164/47, 91, 98, 112, 119, 120

[56] References Cited

U.S. PATENT DOCUMENTS

| | | | |
|---|---|---|---|
| 2,679,669 | 6/1954 | Kempe | 29/156.8 H |
| 2,687,278 | 8/1954 | Smith et al. | 29/156.8 H |
| 3,596,703 | 8/1971 | Bishop et al. | 29/156.8 H |
| 3,756,303 | 9/1973 | Valdo | 164/98 |
| 3,854,195 | 12/1974 | Landig | 29/527.6 |
| 4,384,607 | 5/1983 | Wood et al. | 29/156.8 H |

FOREIGN PATENT DOCUMENTS

| | | |
|---|---|---|
| 2038047 | 2/1972 | Fed. Rep. of Germany . |
| 619722 | 3/1949 | United Kingdom . |

*Primary Examiner*—Daniel C. Crane

*Attorney, Agent, or Firm*—Cushman, Darby & Cushman

[57] ABSTRACT

An aerofoil member such as a blade or vane for a gas turbine engine comprises a hollow aerofoil with a plug of porous material filling a region of the hollow interior. The porous material forms at least part of the external surface of the aerofoil so that cooling fluid can flow from the interior of the aerofoil through the plug to the external surface of the aerofoil. The plug is preferably at the leading or trailing edge of the aerofoil. Methods of making the member include investment casting using a porous ceramic core to form the porous plug, or using sintered particulate material to form the porous plug.

5 Claims, 6 Drawing Figures

METHOD OF MAKING AN AIRFOIL MEMBER FOR A GAS TURBINE ENGINE

This is a division of application Ser. No. 121,481 filed Feb. 14, 1980, now abandoned.

This invention relates to an aerofoil member for a gas turbine engine and a method of making it.

Aerofoil members such as the blades or vanes of gas turbine engines often operate in very hot conditions so that some form of cooling is required to allow the material of the blade or vane to retain reasonably good strength. It is relatively easy to cool some portions of the aerofoil of a blade or vane where there is a considerable thickness available, but at the trailing edge of the aerofoil the blade or vane is desirably very thin so that it has little thermal inertia and provides little space for the provision of cooling. It may also be difficult to cool other regions such as the leading edge where the provision of sufficient film cooling holes is difficult and expensive.

The present invention provides a blade or vane having a relatively efficient form of cooling, for specific regions and a method of making the blade or vane.

According to the present invention an aerofoil member for a gas turbine comprises a hollow aerofoil having a plug of porous material filling a region of its hollow interior the plug of porous material also forming at least part of the surface of the aerofoil whereby cooling fluid can pass from the hollow interior through said plug to the surface of the aerofoil.

In preferred embodiments the plug fills the leading and/or trailing edges of the aerofoil and forms at least part of the leading edge surface and/or the trailing edge region of one flank of the aerofoil.

The invention also includes a method of making the blade or vane comprising forming a hollow aerofoil having a plug of porous material filling a region of its hollow interior, the plug extending beyond the bounds of the required aerofoil shape, and machining the plug, and if necessary the adjacent portions of the aerofoil so that the desired aerofoil shape is produced with at least a region of the surface of the aerofoil comprising said porous material.

Said porous material may be cast in place in the aerofoil, and may be formed using a porous core. Alternatively, it may be sprayed or sintered or otherwise introduced in the form of a plurality of separate particles which may subsequently be fixed together to produce the porous material.

In one embodiment the aerofoil and the porous plug both comprise a metal alloy.

Figure 4:
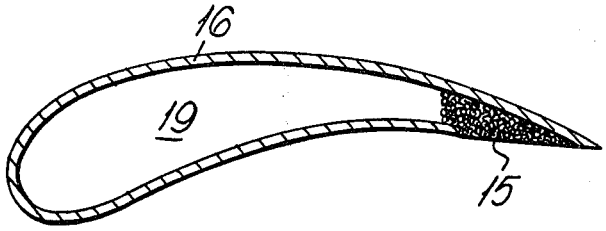
Figure 5:
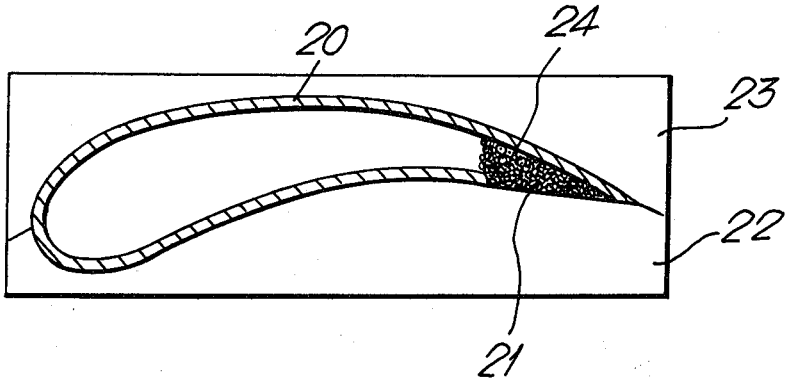
Figure 6:
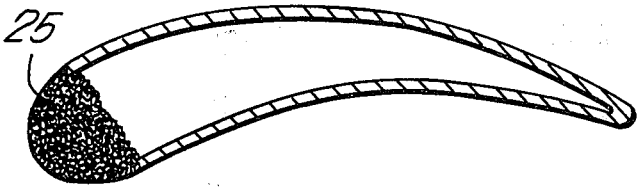

The invention will now be particularly described, merely by way of example, with reference to the accompanying drawings in which:

FIGS. 1 to 4 are sectional views of stages in the manufacture of a blade or vane in accordance with the invention, FIG. 5 is a view similar to FIGS. 1 to 4 but of an alternative embodiment, and FIG. 6 is a view similar to FIGS. 1 to 5 but of a further embodiment.

Figure 1:
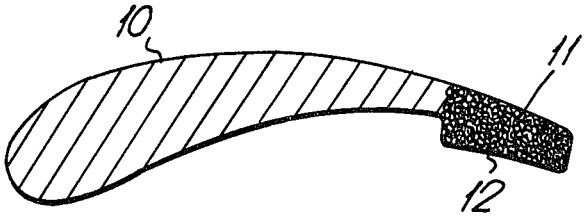

In FIG. 1 there is shown a ceramic core of the type commonly used to define internal cavities in cast objects such as hollow blades or vanes. The core comprises a solid ceramic forward aerofoil portion 10 and a rearward portion 11 formed of a porous ceramic material. The porous material could take one of several forms but it may in particular comprise a reticulated ceramic foam.

It will also be noted that the porous section 11 is not simply of the shape required to complete the aerofoil shape of the forward portion 10 but that it projects at 12 beyond the normal position of the concave flank of the trailing section of the aerofoil.

The composite core may be made by one of a number of methods thus it will be possible to form the portions 10 and 11 separately and to glue them together or it will be possible to devise a method of manufacture in which the two portions are formed simultaneously and as an integral whole.

Figure 2:
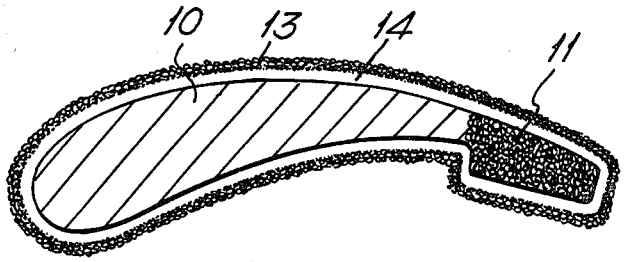
Figure 3:
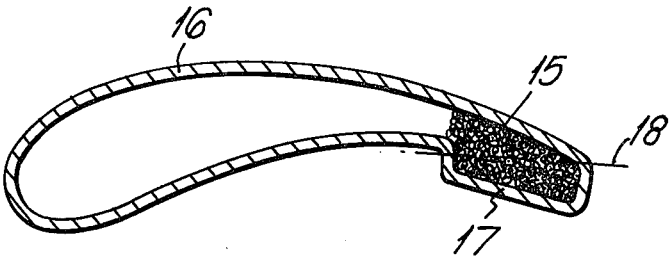

FIG. 2 shows the composite core mounted within a mould after a conventional lost-wax process has been used to form the mould 13. The mould 13 has an internal surface which is of the same shape as the exterior surface of the blade or vane hence leaving a varying gap 14 between the core (including the portion 11) and the mould 13, the gap defining the space to be filled by metal in the casting process. Extensions of the core at each end are located closely in the mould 13 to ensure correct relationship between interior and exterior surfaces of the blade or vane.

The clearance is deliberately formed round the porous piece of core to avoid any possibility of the material of the shell mould encroaching on the porous material and blocking its pores.

It will be appreciated that in using the lost-wax process, the wax former injected round the core will produce a skin which is impermeable to the ceramic slurry used to form the mould. It could be that under favourable circumstances the wax might in any case impregnate the porous material to preclude the ingress of ceramic slurry. In this case the porous ceramic could be arranged to extend only as far as the intended surface of the aerofoil. However, the technique described ensures that no blockage will occur, and the projecting piece 12 may also provide further location for the core within the mould.

As an alternative it may be possible to use a material such as silicone on the porous material which will repel the shell mould material. In this case there would again be no need to cause the porous material to extend beyond the bounds of the aerofoil and to machine this extension off; the porous cast material could be arranged to have the correct surface shape as cast.

It will be understood that at the root and tip it may be desirable to form features such as platforms, shrouds and mounting means but these are produced as an integral part of the aerofoil casting and are not further described in the specification.

When the mould 13 has been formed it is preheated in the normal manner and molten metal is poured into the mould to fill the spaces inside it. Thus the molten metal will fill the clearance 14 between the mould 13 and the core 10 and 11 and it will also permeate the pores of the porous section of the core 11. When the metal has solidified the mould 13 is removed by normal mechanical or chemical means and the composite ceramic core is leached from inside the resulting metal aerofoil. The solid portion 10 of the core are completely removed leaving an empty space within the hollow interior of the aerofoil while the porous portions 11 are also leached out to leave a porous metal plug 15 which fills the trailing region of the aerofoil 16.

As so far described the aerofoil is not a proper aerofoil shape since it has a projection 17 at its trailing edge corresponding to the projection 12 of the portion 11 and the solid metal skin formed between this porous projection and the inner wall of the mould 13. It is necessary to remove this projection and this is done by machining to remove that portion of the projection outside the dotted line 18. The machining could be carried out by a number of methods that would probably involve milling or electro chemical machining. Again, as mentioned above it may be possible to avoid the necessity for this step.

FIG. 4 shows in section the finished vane or blade produced by this method and it will be seen that by machining the projection 17 as described the solid wall of the aerofoil is broken away to expose part of the porous plug 15 which then forms the trailing edge portion of the concave flank of the aerofoil. It will be appreciated that because of the porous nature of a plug 15 it is possible for air or other cooling fluid which flows into the main hollow cavity 19 of the aerofoil to pass through the plug 15 and to the surface of the vane. This passage of cooling fluid cools the trailing edge region of the aerofoil both by its passage through the tortuous pores of the plug 15 and by transpiration or film cooling when it finally reaches the aerofoil surface. Additionally the porous plug 15 links together the two flanks of the aerofoil in the trailing edge region in a highly effective manner which will provide a trailing edge which although very thin can be given considerable strength.

There are of course alternative ways in which the vane or blade could be made. Thus in particular it will be possible to manufacture simply the hollow shell 16 by a casting method and subsequently to introduce a particulate material into the trailing edge region of the hollow interior by flame spraying or sintering or other methods. If necessary the porous plug thus formed could then be sintered by a heat treatment method before the projecting portion is machined away as in the preceding embodiment.

FIG. 5 shows a yet further method of making a vane or blade in which a metal shell 20 is produced by a casting method similar to that described above. The shell 20 is made so that instead of the projection 17 it has a gap 21 in its wall. The shell 20 is then assembled into a split die made up of the pieces 22 and 23, and while it is held there a particulate material is introduced into the trailing portion of its hollow interior to form a plug 24. As before this plug may be sintered giving it sufficient strength. It will be seen that using this latter method the plug 24 is produced with its surface already forming part of the aerodynamic surface of the aerofoil of the vane and it is not necessary to carry out further machining on the plug.

FIG. 6 shows how the invention may be applied to parts of the aerofoil other than the trailing edge. In this particular instance the porous material 25 forms the leading edge of the aerofoil. This is a particularly beneficial place to use the porous material since it is normally difficult and expensive to drill or otherwise produce the large number of film cooling holes required in this region.

The porous material 25 can be formed in the leading edge, or indeed in any other part of the aerofoil, by any of the techniques referred to above.

Clearly the method of invention is primarily applicable to metallic aerofoils although it could be used with ceramic or other material. It should also be noted that the parameters of the porous plug should be chosen to give the desired cooling performance and/or strength to the region of the aerofoil composed of the porous material.

We claim:

1. A method of making an aerofoil member for a gas turbine engine, the aerofoil member having an aerofoil-shaped exterior surface and a hollow interior with a plug of reticulated porous material filling a region of the hollow interior and forming at least a part of the exterior surface of the aerofoil member whereby cooling fluid can pass from the hollow interior through the plug to the exterior of the aeorofoil member, said method comprising the steps of:

forming a composite core having a solid portion defining the hollow interior of the aerofoil member and a porous portion of reticulated foam material defining the region for and the pores for the plug of porous material;

providing a mold around the core with a clearance therebetween to define the exterior surface of the aerofoil member;

then casting metal into the clearance formed between the composite core and the mold and into the porous portion of reticulated foam material of the composite core so that the reticulated porous plug is cast as an integral part of the hollow aerofoil member;

and then removing the mold and the composite core from the cast aerofoil blade member.

2. A method of making an aerofoil member as claimed in claim 1 and further comprising initially forming said porous portion of reticulated foam material of the core so that the porous plug, after casting, extends beyond the bounds of the required aerofoil-shaped exterior surface of the aerofoil member, and subsequently machining the cast reticulated porous plug so that the desired aerofoil-shaped external surface of the aerofoil member is produced with at least a region of the aerofoil-shaped external surface comprising said porous plug.

3. A method of making an aerofoil member as claimed in claim 2 in which the machining of the cast reticulated porous plug is by milling or by electrochemical machining.

4. A method of making an aerofoil member as claimed in any one of claims 1 to 3 in which the porous portion of reticulated foam material of the composite core is made of ceramic.

5. A method of making an aerofoil member as claimed in any one of claims 1 to 3 in which both the solid portion and the porous portion of reticulated foam material of the composite core is made of a ceramic.

* * * * *